United States Patent [19]

Tenenbaum et al.

[11] Patent Number: 4,640,102

[45] Date of Patent: Feb. 3, 1987

[54] SELF-COOLING CONTAINER FOR BEVERAGES

[76] Inventors: Marcos Tenenbaum; Luis De Guzman; Daniel M. Tenenbaum, all of 3559 Paraguay Street, 6th Floor - A, Buenos Aires 1425, Argentina

[21] Appl. No.: 835,622

[22] Filed: Mar. 3, 1986

[51] Int. Cl.[4] ..... F25D 3/10

[52] U.S. Cl. ..... 62/294; 62/4; 62/457

[58] Field of Search ..... 62/294, 457, 4

[56] References Cited

U.S. PATENT DOCUMENTS 3,494,142 2/1970 Beck ..... 62/294

3,520,148 7/1970 Fuerle ..... 62/294

3,881,321 5/1975 Riley ..... 62/294

FOREIGN PATENT DOCUMENTS 2223986 10/1974 France ..... 62/294

*Primary Examiner*—Lloyd L. King

*Attorney, Agent, or Firm*—Richard L. Miller

[57] ABSTRACT

A self-cooling container for beverages is provided and contains a capsule having pressurized liquified coolant within. The capsule is placed within the container so that a conduit will extend from the capsule to a bent obstructed end having a semi-cut portion. When the bent end is removed the coolant will exit the conduit into the ambient air causing the beverage to cool.

5 Claims, 3 Drawing Figures

SELF-COOLING CONTAINER FOR BEVERAGES

BACKGROUND OF THE INVENTION

The instant invention relates generally to liquid holding containers and more specifically it relates to a self-cooling container for beverages.

Numerous liquid holding containers such as cans, have been provided in prior art that are adapted to carry soft drinks and the like and are easy to carry because of their relative small size. While these units may be suitable for the particular purpose to which they address, they would not be as suitable for the purposes of the present invention as heretofore described.

SUMMARY OF THE INVENTION

A primary object of the present invention is to provide a self-cooling container for beverages that will overcome the shortcoming of the prior art devices.

Another object is to provide a self-cooling container for beverages, that contains a capsule with pressurized liquified coolant within the capsule placed within the container so that when the coolant is released through a conduit at the top end of the container the beverage will cool.

An additional object is to provide a self-cooling container for beverages in which the conduit contains a semi-cut portion at a bent obstructed end and keeps the coolant separated from the beverage within the container so that the bent end may be broken off releasing the coolant into the ambient air and thus cool the contents of the container.

A further object is to provide a self-cooling container for beverages that is simple and easy to use.

A still further object is to provide a self-cooling container for beverages that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
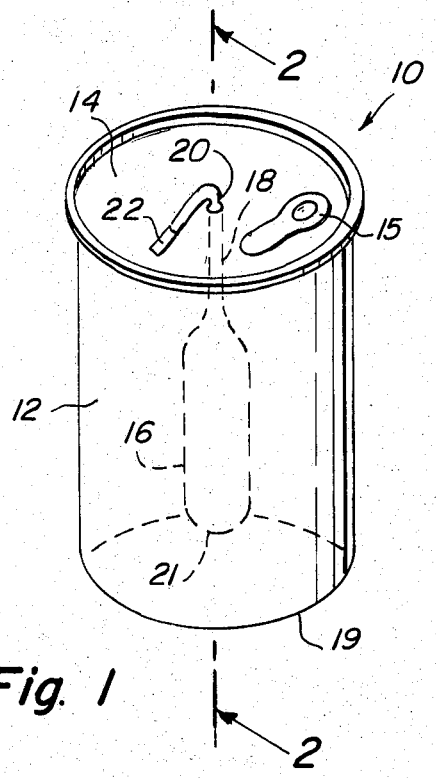
FIG. 1 is a perspective view of the invention.
Figure 2:
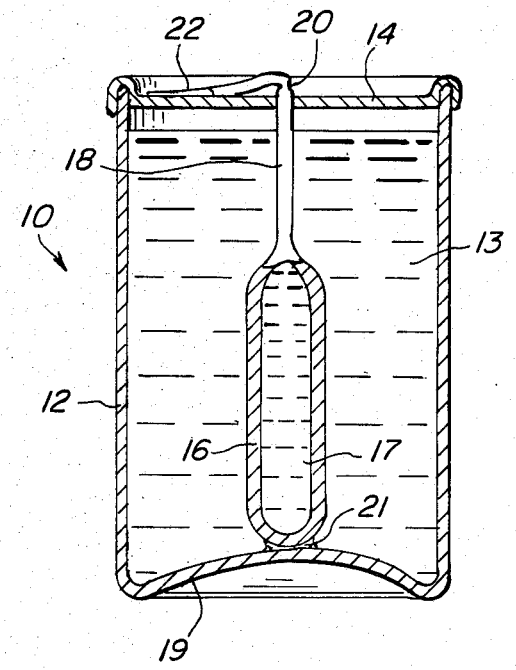
FIG. 2 is an enlarged cross sectional view taken along line 2—2 in FIG. 1.
Figure 3:
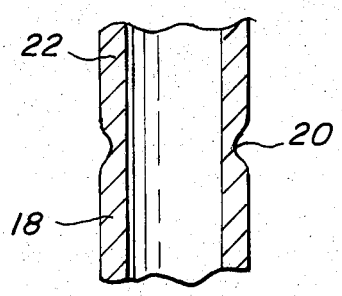
FIG. 3 is an enlarged cross sectional view of the semi-cut portion of the conduit in FIG. 2.

Turning now descriptively to the drawings, in which similar reference characters denote similar elements throughout the several views, FIGS. 1 and 2 illustrate a self-cooling container 10 for its contents 13, typically a beverage, such as soda, beer or the like. The container

10 basically consists of a housing 12, a top end 14, a capsule 16 and a conduit 18.

The housing 12 is for holding the beverage 13 therein while the top end 14 which is secured to the housing 12, has a opening tab 15 for removing the beverage 13 from the housing. The capsule 16 has pressurized liquified coolant 17 therein. The capsule 16 is immersed in the beverage 13 and affixed to bottom 19 of the housing 12 at 21 by spot welding or the like. The conduit 18 extends from the capsule 16 through the top end 14. The conduit has a bent obstructed distal end 22 with a semi-cut weakened annular grove 20 around said conduit 18 which will fracture and easily break when a sufficient amount of force is applied at end portion 22. When the bent distal end 22 is thus removed at the semi-cut annular grove 20 the coolant 17 will escape quite rapidly through the conduit 18 into the ambient air causing the beverage 13 to be cooled within the housing 12, due to the rapid absorption of heat by the expanding coolant.

The housing 12, the top end 14, the capsule 16 and the conduit 18 may be fabricated out of durable material such as aluminum.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A self-cooling container for a beverage which comprises:

(a) a housing for holding said beverage therein;

(b) a top end having an opening tab for removing the beverage from said housing, said top end secured to said housing;

(c) a capsule having pressurized coolant therein, said capsule being immersed in said beverage and means for affixing said capsule to a bottom of said housing; and (d) a conduit extending from said capsule through said top end, said conduit having a bent obstructed distal end and means for removing said bent obstructed distal end, where by when said bent obstructed distal end is removed at said semi-cut portion, said coolant will escape through said conduit into ambient air causing said beverage to be cooled within said housing.

2. A self-cooling container as recited in claim 1 wherein said means for affixing said capsule to said container is a spot weld.

3. A self-cooling container as recited in claim 2 wherein said means for for removing said bent obstructed distal end, is a semi-cut weakened annular grove around said conduit which will fracture when a sufficient amount of force is applied to said bent obstructed distal end.

4. A self-cooling container as recited in claim 3 wherein said housing, said top end, said capsule and said conduit are fabricated out of durable material.

5. A self-cooling container as recited in claim 4 wherein said material is aluminum.

* * * * *